US007490670B2

(12) United States Patent
Aguilera

(10) Patent No.: US 7,490,670 B2
(45) Date of Patent: Feb. 17, 2009

(54) SUBSEA EXPLOITATION DEVICE

(75) Inventor: Patrice Aguilera, Hvalstad (NO)

(73) Assignee: Vetco Gray Scandinavia AS, Billingstad (NO)

( * ) Notice: Subject to any disclaimer, the term of this patent is extended or adjusted under 35 U.S.C. 154(b) by 0 days.

(21) Appl. No.: 10/754,553

(22) Filed: Jan. 12, 2004

(65) Prior Publication Data

US 2004/0140098 A1 Jul. 22, 2004

(51) Int. Cl.
*E21B 29/12* (2006.01)

(52) U.S. Cl. ..... 166/341; 166/342; 166/343

(58) Field of Classification Search ..... 166/341–343, 166/357, 105

See application file for complete search history.

(56) References Cited

U.S. PATENT DOCUMENTS

| | | | | | |
|---|---|---|---|---|---|
| 3,877,520 | A | * | 4/1975 | Putnam | 166/366 |
| 3,987,638 | A | * | 10/1976 | Burkhardt et al. | 405/203 |
| 4,174,011 | A | * | 11/1979 | Zaremba | 175/7 |
| 4,199,275 | A | * | 4/1980 | Tuson | 405/195.1 |
| 4,286,665 | A | * | 9/1981 | Walker | 166/339 |
| 4,438,817 | A | * | 3/1984 | Pokladnik et al. | 166/341 |
| 4,444,275 | A | * | 4/1984 | Beynet et al. | 175/7 |
| 4,625,804 | A | * | 12/1986 | Allen, Jr. | 166/338 |
| 4,784,527 | A | * | 11/1988 | Hunter et al. | 405/207 |
| 4,832,124 | A | | 5/1989 | Rayson | |
| 4,907,914 | A | * | 3/1990 | Gunderson et al. | 405/224 |
| 5,085,277 | A | * | 2/1992 | Hopper | 166/341 |
| 5,192,167 | A | | 3/1993 | da Silva et al. | |
| 5,299,641 | A | | 4/1994 | Paulo et al. | |
| 5,526,882 | A | * | 6/1996 | Parks et al. | 166/339 |
| 5,722,796 | A | * | 3/1998 | Halvorsen et al. | 405/195.1 |
| 5,992,526 | A | * | 11/1999 | Cunningham et al. | 166/343 |
| 6,231,265 | B1 | * | 5/2001 | Rytlewski et al. | 403/322.1 |
| 6,325,159 | B1 | * | 12/2001 | Peterman et al. | 175/7 |
| 7,048,060 | B2 | * | 5/2006 | Østergaard | 166/357 |

FOREIGN PATENT DOCUMENTS

| | | |
|---|---|---|
| FR | 2 473 673 A | 12/1981 |
| GB | 2127465 | 4/1984 |
| GB | 2347183 | 8/2000 |
| NO | 153777 | 3/1979 |
| NO | 302713 | 4/1992 |
| NO | 301555 | 2/1996 |
| NO | 307307 | 4/1999 |
| WO | WO 96/06260 A1 | 2/1996 |
| WO | WO 99/23351 A1 | 5/1999 |

* cited by examiner

*Primary Examiner*—Thomas A Beach
(74) *Attorney, Agent, or Firm*—Venable LLP; Eric J. Franklin

(57) ABSTRACT

A subsea oil and/or gas exploitation device including at least one guide member for guiding subsea equipment that is to be landed and connected to the device into a connecting position in relation to the device. The at least one guide member includes an array of projections provided for the purpose of engaging corresponding recesses arranged in a corresponding guide member of the subsea equipment.

18 Claims, 2 Drawing Sheets

SUBSEA EXPLOITATION DEVICE

TECHNICAL FIELD

The present invention relates to a subsea oil and/or gas exploitation device, comprising at least one guide member for guiding subsea equipment that is to be landed and connected to said device into a connecting position in relation to said device.

It should be understood that such "guiding" may include that either of the device itself or the subsea equipment to which it is to be connected defines the moving element, the movement of which is controlled or affected by means of the guide member.

It should be noted that the device may define any element or module that is to be connected to other elements or modules in a subsea plant or installation. However, as the invention is particularly suitable for improving the guiding of Christmas tree (X-mas tree) or valve tree constructions and blow out preventing (BOP) devices onto well templates that form a base unit on the sea bottom, the invention will be described by way of example to such an application.

BACKGROUND OF THE INVENTION AND PRIOR ART

According to prior art, for example as described in U.S. Pat. No. 4,174,011, a subsea oil or gas exploitation device comprises a sea floor template that is lowered to the sea bottom for the purpose of defining a base for further equipment needed, such as a Christmas tree construction for each drill hole and a blow out preventer device.

Typically, the template comprises a plurality of well subsea equipment guides. Normally, such well equipment guides comprise a plurality of posts that stand up from a position adjacent individual drilling holes. From said posts, guiding wires extend to a top side device such as a floating vessel, from which further equipment such as Christmas tree arrangements and BOP devices can be lowered down to their operative position on top of the template, initially guided by the wires and finally by the posts. For this purpose, holes or the like are provided in the equipment in question for reception of said posts.

This kind of wire guideline arrangement has the advantage of permitting relatively rapid and precise guiding of said equipment down to the template, as long as the depth does not become too large. At larger depths, for example more than 800 meters, it will become increasingly difficult to avoid that the wires get twisted into each other due to their movements as a result of underwater streams etc. If the wires get twisted, further guiding by means thereof becomes impossible, something that cannot be tolerated for safety reasons as well as operational and economical reasons.

THE OBJECT OF THE INVENTION

It is an object of the present invention to present a subsea oil and/or gas exploitation device as initially defined that facilitates positioning of subsea equipment onto said exploitation device without the use of guidelines that extend from a top side arrangement to the device that defines the base for the equipment, or to the equipment, if it is the latter that defines the base for the device.

The inventive device shall promote a smooth positioning into engagement between the device and the equipment, regardless which one of the two is the moving one.

It is also an object to provide a device that promotes firm engagement between the device and the equipment that is to be connected thereto.

BRIEF DESCRIPTION OF THE INVENTION

The object of the invention is achieved by means of the initially defined device, characterised in that said at least one guide member comprises an array of projections provided for the purpose of engaging corresponding recesses arranged in a corresponding guide member of the subsea equipment.

Preferably, each projection has a tapered end portion for the purpose of facilitating the initial insertion of the projection into the corresponding recess.

For the purpose of further facilitating the insertion of the projections into the recesses each projection comprises an outer layer of a low-friction material, preferably a polymer, most preferably poly-tetra-fluor-ethylene, PTFE. As an alternative or supplement thereto, the inner periphery of the recesses may also present a layer of a low-friction material, such as PTFE or any other suitable polymer that is able to withstand the harsh conditions at the operation site of the device.

The object of the invention is also achieved by means of the initially defined device, characterised in that each guide member comprises an array of recesses provided for the purpose of engaging corresponding projections arranged at a corresponding guide member of the subsea equipment to be connected thereto. As seen, this is the inverted case of the device as described above.

Preferably, the device comprises a hollow body, the inner periphery of which defines a truncated cone, said recesses being provided in the wall of said body. Thanks to the provision of this specific geometry, the walls that define the truncated cone can be taken advantage of for the purpose of initially catching and guiding a corresponding guide member of the equipment into alignment with the guide member of the device.

According to a preferred embodiment, the hollow body defines a funnel, and the recesses are provided in the wall of the funnel.

Preferably, the projections or recesses of an individual guide member are evenly angularly distributed around a centre axis of the guide member. In particular, in the case the subsea equipment is a Christmas tree or a blow out preventer said projections or recesses are preferably evenly angularly distributed around a centre axis of a well hole or a well drill hole or a pipe leading from such a hole of the guide member as well.

According to one embodiment of the invention the device is a base device that is to be located on the sea bottom. Preferably, the device defines a template, and the equipment that is to be seated thereon may for instance comprise a Christmas tree and/or a blow out preventer device. The inverted case is also possible, i.e. when the device constitutes a Christmas tree or a blow out preventer device.

However, it should be understood that the device, in a more general embodiment of the invention, may constitute any element or module for subsea operation that is to be connected to further subsea equipment. Examples of such modules are a pump, e.g. an electric pump, a de-sander apparatus, a de-oiler apparatus, a separator, a transformer or a subsea frequency converter.

Further features and advantages of the present invention are to be found in the following detailed description of a preferred embodiment as well as in the accompanying drawings.

BRIEF DESCRIPTION OF THE DRAWINGS

Preferred embodiments of the present invention will now be described with reference to the annexed drawings on which.

DETAILED DESCRIPTION OF THE INVENTION

Figure 1:
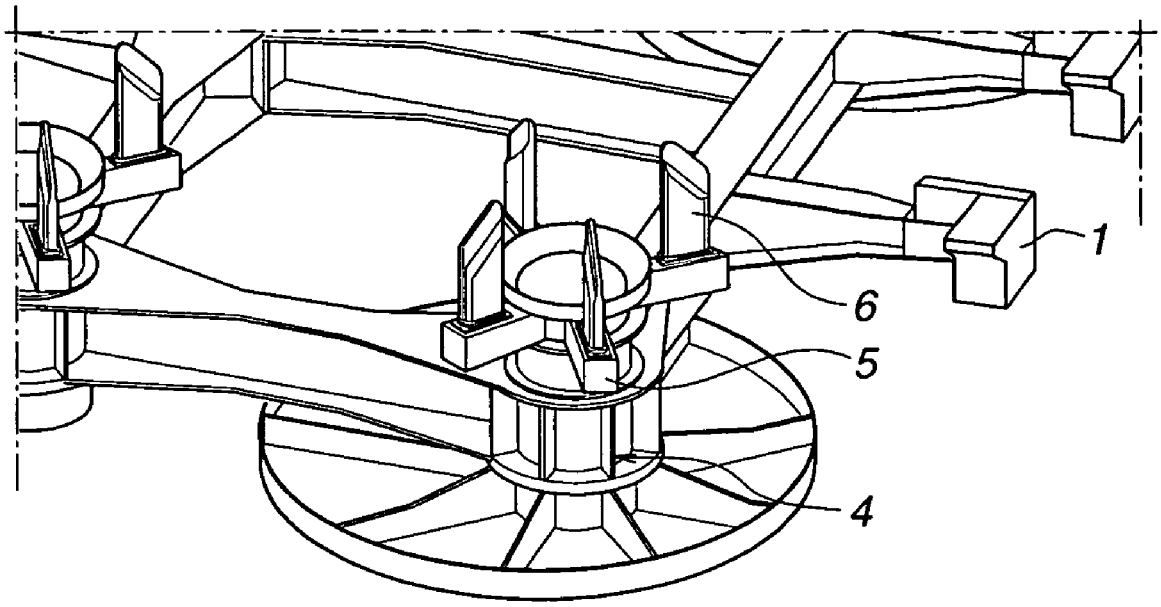
FIG. 1 is a schematic perspective view of a well slot in a template/device showing a guidelineless permanent guide base according to a first embodiment of the invention.

FIG. 1 shows a schematic perspective view of a well slot in a template/device with a guidelineless permanent guide base (GLL PGB) according to a first embodiment of the invention. The device comprises a well template or base structure 1 that is provided for the purpose of operating as a supporting and stabilising frame at the bottom of the sea and to which further well subsea equipment such as, here, a plurality of Christmas tree arrangements 2 and a blow out preventer 3 are attached substantially vertically from above.

The well template 1 comprises a plurality of interconnected structure parts at least some of which presents a well hole or a well drill hole guiding element 4. Here, the well hole guiding element 4 comprises a body with a throughole or an upstanding tube, through which a well-head will be guided and landed and to which a Christmas tree arrangement 2 is to be connected and locked into in order to conduct oil and/or gas that is obtained from the well through a manifold system of the template to further equipment such as, for example, different kinds of separators for separation of oil from water and gas.

Circumferentially around at least some of the well hole guiding elements 4, there is arranged a guiding member 5 including a guidelineless permanent guide base that comprises an array, here an annular pattern, of projections in the form of vertically arranged, upstanding or projecting fins 6 for the purpose of engaging any equipment that is to be landed or attached to the structure part in question. Such equipment may include a Christmas tree 2 or a BOP 3. In the preferred embodiments as shown in FIGS. 1-4, each fin 6 has a generally rectangular cross section. The free end of each fin 6 is tapered in a radial direction such that it has a sloping radial outer edge. The thickness of each fin 6 is also reduced towards the free end thereof. The set of fins 6 defines a fin block or key element. Further, the fins 6 are permanently installed but are preferably designed removably arranged so as to be easily retrievable by a remotely operated vehicle (ROV) in order to for example replace them in case of damage.

Figure 2:
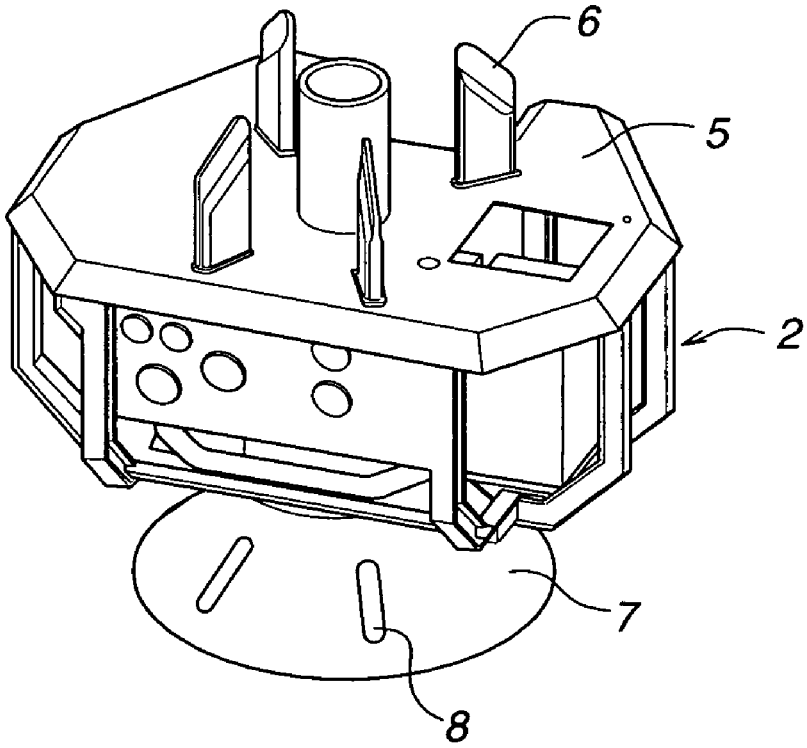
FIG. 2 is a schematic perspective view of a second embodiment of a device according the invention, where the subsea equipment is a X-mas tree.
Figure 3:
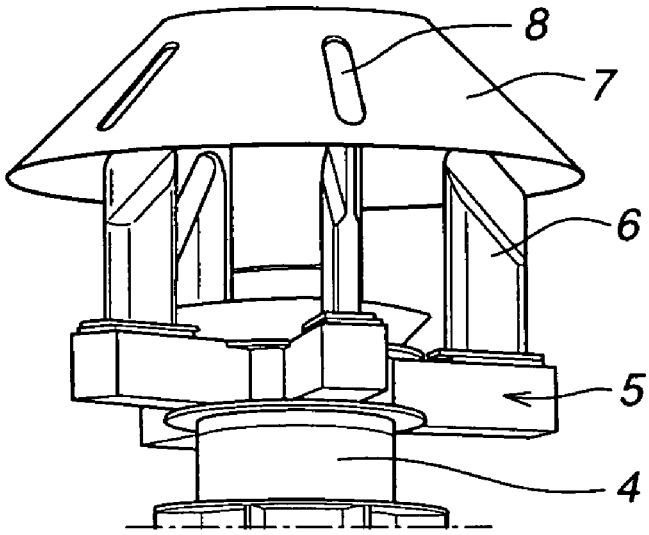
FIG. 3 is a schematic perspective view showing a device according to the invention during connection to further subsea equipment, provided with a guide member according to the invention.
Figure 4:
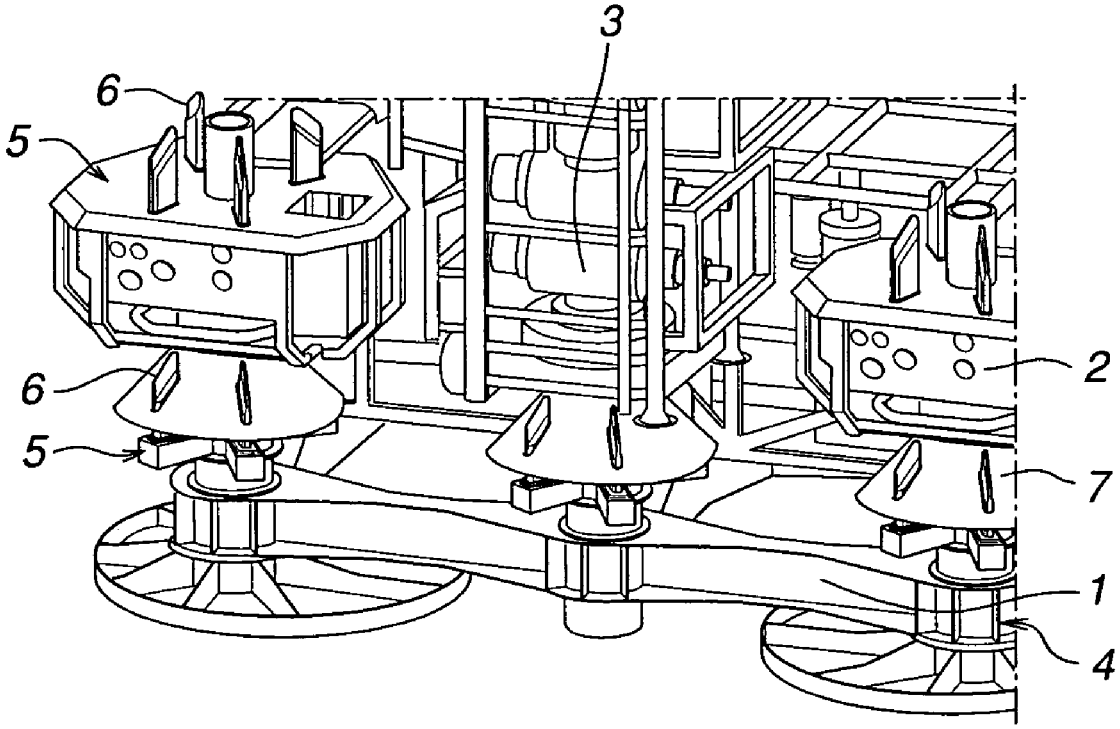
FIG. 4 is a view showing a set of Christmas tree arrangements and a BOP in a position in which they are landed onto their respective well slots of a well template.

In FIG. 2 there is shown a supplementing guide member 7 that is advantageously attached to or forming part of a subsea equipment, such as a Christmas tree 2, to be guided to and landed on one of the parts of the template adapted for that purpose. The supplementing guide member 7 comprises a funnel the wide end of which is pointing towards the guiding member 5 arranged thereunder (not shown) during the landing of the Christmas tree 2 on the template 1.

In the wall of the funnel 7 there are provided recesses in the form of slots or guiding openings 8 each of which extends through the funnel wall. The number of slots and the array in which they are positioned corresponds to the number of fins 6 and the array in which the fins 6 are arranged. Accordingly, the guide member 5 matches the supplementing guide member 7.

The fins 6 of guide member 5, and the slots 8 of the supplementing guide member 7, are arranged in a generally uniform pattern around and at an equal distance from a centre axis of the guide member 5 and supplementing guide member 7 respectively. Accordingly, the slots 8 are arranged equidistant from the centre axis, the longitudinal axis, of the funnel 6, while the fins 6 are arranged generally equidistant from the through-hole of the well hole guiding element 4. Preferably, the number of fins 6 of a single guide member 5 is three or four. However, other numbers are also contemplated within the scope of the invention.

The fins 6 and the slots 8 may preferably be angularly evenly distributed with regard to the central axis of the guide member 5 and the supplementing guide member 7 (the funnel) respectively. The width of the wide end of the funnel 7 is substantially larger than the maximum width occupied by the set of fins 6 of one individual guide member, such that the funnel 7 will actually act as a guide for guiding the fins 6 into engagement with the slots 8, or guiding the slots 8 into engagement with the fins 6, depending on which part is the moving one. For the purpose of further facilitating the insertion of the fins into the slots, each fin in the preferred embodiments as shown in FIGS. 1-4 is covered with an outer low-friction material layer of poly-tetra-fluor-ethylene, PTFE. As an alternative or supplement thereto, the inner periphery of the slots may also preferably be provided with a layer of PTFE or any other suitable polymer that is able to withstand the harsh conditions at the operation site of the device.

It should be understood that the invention also includes the inverted situation when the guide member 7 consisting of funnel 7 with slots 8 is provided on the template 1, and the corresponding guide member 5 with the fins 6 is provided on the subsea equipment 2, 3 to be landed on the template and connected thereto.

In particular, as can be seen in FIG. 2, the invention also suggests the use of a double-directed guide connection arrangement comprising two guide members 5, 7 that are arranged for connection to a respective corresponding or supplementing guide member in opposite directions. Any subsea equipment, such as the X-mas tree as shown in FIG. 2, that is likely to be in an intermediate position, connected to other equipment below as well as above itself, may preferably be provided with such a double-directed connection arrangement.

It should be realised that the above presentation of the invention has been made by way of example, and that alternative embodiments will be obvious for a person skilled in the art without going beyond the scope of protection as claimed in the annexed patent claims supported by the description and the annexed drawings.

For example, a plurality of projection, recess and funnel geometries is possible within the scope of the invention, as well as the number of fins and openings and the patterns in which they are arranged.

The main advantage of the invention is, however, that it promotes landing and engagement of equipment on a subsea oil and gas exploitation device at large depths without the need of using particular guidelines for that purpose.

The invention claimed is:

1. A subsea oil and/or gas exploitation device, comprising:

at least one projecting guide member comprising a plurality of generally vertically extending projections arranged about a central axis, each projection having a radially sloped upper edge; and at least one receiving guide member comprising a receiving structure, each receiving structure having an inner surface defining a truncated cone that is radially sloped in a similar direction to the upper edges of the projections, the truncated cone at a wider end extending further from the central axis than the projections, each receiving structure being operative to engage the plurality of projections on the at least one projecting guide member, each receiving structure comprising a plurality of recesses extending through the inner surface of the receiving structure, each recess engaging and surrounding one of the projections, such that each projection extends throughout and vertically above each corresponding recess, wherein said receiving guide member itself is operatively arranged to guide subsea equipment that is to be landed and connected to said device into a connecting position in relation to said device.

2. The device according to claim 1, wherein each projection has a thickness that is reduced toward a free end thereof.

3. The device according to claim 1, wherein each projection comprises an outer layer of a low-friction material.

4. The device according to claim 1, wherein the receiving structure comprises a hollow body that defines a funnel, and wherein the recesses are provided in a wall of the funnel.

5. The device according to claim 1, wherein the projections are arranged circumferentially around a center axis of each projecting guide member and the recesses are arranged circumferentially around a center axis of each receiving guide member.

6. The device according to claim 1, wherein the device defines a well template and wherein the equipment to be seated thereon comprises a Christmas tree and/or a blow out preventer device.

7. The device according to claim 1, wherein the projections of each projecting guide member or recesses of each receiving guide member are arranged around a center axis of each projecting guide member or each receiving guide member.

8. The device according to claim 1, wherein the projections of each projecting guide member or recesses of each receiving guide member are evenly angularly distributed around a center axis of each projecting guide member or each receiving guide member.

9. The device according to claim 1, wherein the device is a base device that is to be located on the sea bottom.

10. The device according to claim 6, wherein the device comprises a plurality of said projecting guide members and said receiving guide members, one for each well or drill hole.

11. The device according to claim 1, wherein the device defines a Christmas tree or a blow out preventer device.

12. The device according to claim 1, wherein the device defines any one of a pump, a de-sander, a de-oiler, a separator, a transformer or a subsea frequency converter.

13. The device according to claim 3, wherein the low-friction material comprises a polymer.

14. The device according to claim 13, wherein the polymer comprises poly-tetra-fluor-ethylene.

15. The device according to claim 1, wherein the at least one receiving guide member is arranged on subsea equipment that is to be landed.

16. The device according to claim 1, wherein the projections are removably arranged about the central axis.

17. A subsea oil and/or gas exploitation device, comprising:

at least one projecting guide member comprising a plurality of generally vertically extending projections arranged about a central axis, each projection having a radially sloped lower edge; and at least one receiving guide member comprising a receiving structure, each receiving structure having an inner surface defining a truncated cone that is radially sloped in a similar direction to the lower edges of the projections, the truncated cone at a wider end extending further from the central axis then the projections, each receiving structure being operative to engage the plurality of projections on the at least one projecting guide member, each receiving structure comprising a plurality of recesses extending through the inner surface of the receiving structure, each recess engaging and surrounding one of the projections, such that each projection extends throughout and vertically below each corresponding recess, wherein said receiving guide member itself is operatively arranged to guide subsea equipment that is to be landed and connected to said device into a connecting position in relation to said device.

18. The device according to claim 17, wherein the at least one projecting member is arranged on subsea equipment that is to be landed.

* * * * *